US006698436B1

(12) United States Patent
Covitz et al.

(10) Patent No.: US 6,698,436 B1
(45) Date of Patent: Mar. 2, 2004

(54) PROCESS AND APPARATUS FOR ASSEMBLING FILTER HOLDERS FOR USE IN A SMOKING MACHINE

(75) Inventors: Beverly G. Covitz, Moseley, VA (US); Matthew Damien Cooke, Louisa, VA (US)

(73) Assignee: Philip Morris Incorporated, New York, NY (US)

( * ) Notice: Subject to any disclaimer, the term of this patent is extended or adjusted under 35 U.S.C. 154(b) by 17 days.

(21) Appl. No.: 10/212,846

(22) Filed: Aug. 5, 2002

(51) Int. Cl.[7] ..... A24F 25/00
(52) U.S. Cl. ..... 131/329
(58) Field of Search ..... 131/330, 179, 131/175, 329

(56) References Cited

U.S. PATENT DOCUMENTS

| | | | |
|---|---|---|---|
| 2,228,216 | A | 1/1941 | Morgan |
| 3,200,648 | A | 8/1965 | Waggaman |
| 3,433,054 | A | 3/1969 | Mutter |
| 3,460,374 | A | 8/1969 | Parks |
| 3,476,119 | A | 11/1969 | Walton |
| 3,528,435 | A | 9/1970 | Morrissey |
| 3,548,840 | A | 12/1970 | Baumgartner |
| 3,548,841 | A | 12/1970 | Caughey |
| 3,732,874 | A | 5/1973 | Wagner et al. |
| 4,019,366 | A | 4/1977 | Claflin et al. |
| 4,140,003 | A | 2/1979 | Pillsbury, Jr. et al. |

FOREIGN PATENT DOCUMENTS

| | | | |
|---|---|---|---|
| GB | 1356012 | * | 6/1974 |

* cited by examiner

*Primary Examiner*—Dionne A. Walls
(74) *Attorney, Agent, or Firm*—Connolly Bove Lodge & Hutz

(57) ABSTRACT

Process and apparatus for preparing a plurality of filter holders for use in a smoking machine both include assembling a plurality of such filter holders, each holder having upper and lower portions constructed and arranged for fitting engagement with one another. A filter element is placed between the upper and lower portions of each filter holder, and each holder is loosely assembled by fitting the upper and lower portions together with the filter element therebetween. The loosely assembled filter holders are placed on a portable tray having a plurality of individual compartments, one for each loosely assembled filter holder. The portable tray is placed within a press for pressing the filter holder portions together to thereby simultaneously seal the upper and lower portions of each filter holder together with the filter element therebetween.

5 Claims, 2 Drawing Sheets

PROCESS AND APPARATUS FOR ASSEMBLING FILTER HOLDERS FOR USE IN A SMOKING MACHINE

BACKGROUND OF THE INVENTION

The present invention relates to a process and apparatus for assembling a plurality of filter holders for use in a smoking machine.

Automated smoking machines are old in the art, and these machines are primarily used for the collection and subsequent analysis of tobacco smoke constituents. Standards for puff volume, puff profile and puff duration, together with sample preparation and analysis are followed in the operation of such smoking machines.

Numerous smoking machines have been proposed and developed within the prior art. Typical machines for smoking cigarettes are disclosed in the following U.S. Patents, all of which are incorporated by reference in the present application. These Patents include U.S. Pat. Nos. 2,228,216, 3,200,648, 3,433,054, 3,460,374, 3,476,119, 3,528,435, 3,548,840, 3,548,841, 3,732,874, 4,019,366 and U.S. Pat. No. 4,140,003. Many of these automated smoking machines are a parallel or all-at-a-time type of device where each cigarette in a group of 20 is simultaneously puffed about once every 60 seconds. Other known machines are capable of smoking cigarettes in a predetermined sequence.

Prior to actually using an automated smoking machine, filter holders must be assembled by placing a clean filter element between the upper and lower portions of each of a plurality of such filter holders. The upper portion of the filter holder has an opening for receiving a cigarette and the lower portion has an opening for releasable attachment to the smoking machine. Normally, each loosely assembled filter holder is individually pressed to seal the upper and lower portions thereof together with the filter element therebetween. Such procedure for preparation of the filter holders is both time consuming and inefficient.

SUMMARY OF THE INVENTION

Accordingly, one of the objects of the present invention is a process for assembling a plurality of filter holders for use in a smoking machine where the plurality of holders is simultaneously pressed to thereby seal to upper and lower portions of each filter holder together with the filter element therebetween.

Another object of the present invention is a press for assembling a plurality of filter holders for use in a smoking machine where the plurality of loosely assembled holders is simultaneously pressed to thereby seal the upper and lower portions of each filter holder together with the filter element therebetween.

In accordance with the present invention, a process for assembling a plurality of filter holders for use in a smoking machine comprises the steps of providing a plurality of filter holders, each holder having upper and lower portions constructed and arranged for fitting engagement with one another. A filter element is placed between the upper and lower portions of each filter holder, and each holder is loosely assembled by fitting the upper and lower portions together with the filter element therebetween. The loosely assembled filter holders are placed on a portable tray having a plurality of individual compartments, one for each assembled filter holder. The portable tray is then positioned in a press, and the filter holders are simultaneously pressed to thereby seal the upper and lower portions of each holder together with the filter element therebetween.

The present invention also includes a particular press for assembling a plurality of filter holders for use in a smoking machine. The press comprises a framework, and a press platen is mounted to the framework for vertical movement. A portable and removable tray is supported by the framework directly below the press platen, and an alignment structure on the framework and tray positions the tray at an exact predetermined location directly below the press platen. At least one hydraulic cylinder is connected between the framework and press platen for moving the platen in a vertical direction toward and away from the tray and the loosely assembled filter holders. Moreover, the tray includes a plurality of individual compartments, one compartment for holding one of the plurality of loosely assembled filter holders, and the press platen also includes a similar plurality of individual compartments, one for engaging each of the plurality of filter holders during pressing upon actuation of the at least one hydraulic cylinder.

BRIEF DESCRIPTION OF THE DRAWINGS

Novel features and advantages of the present invention in addition to those noted above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
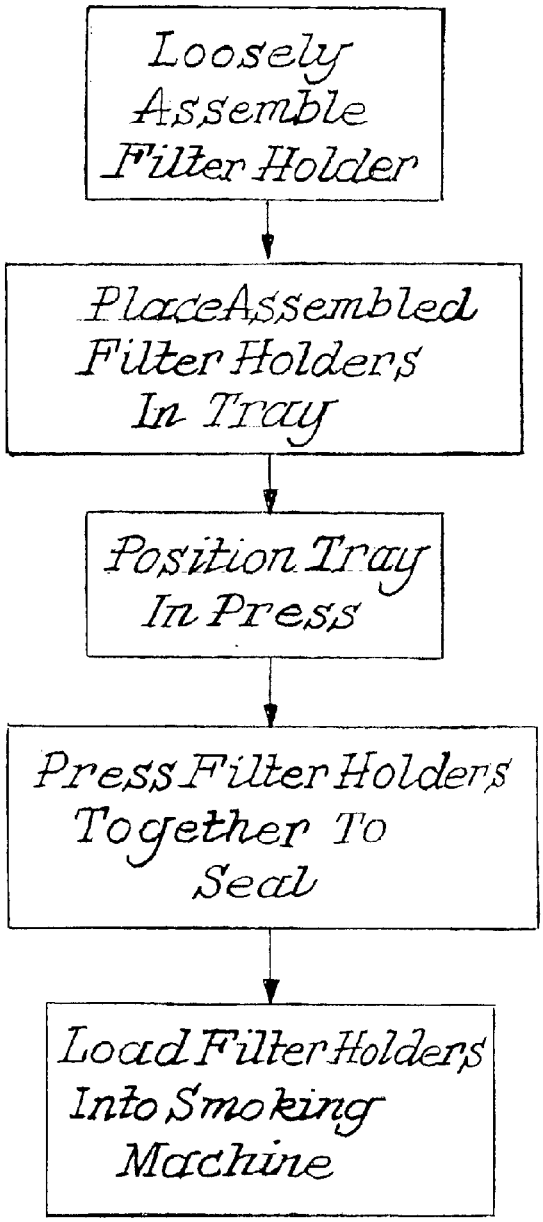
FIG. 1 is a flow diagram illustrating a process for assembling a plurality of filter holders for use in a smoking machine, according to the present invention.
Figure 2:
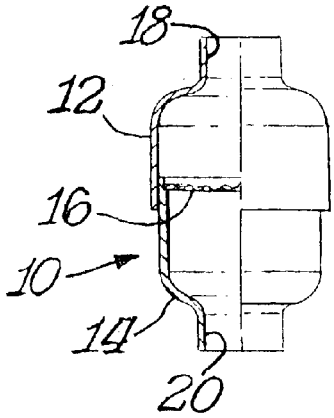
FIG. 2 is a side elevational view of a loosely assembled filter holder with a filter element between the upper and lower portions of the holder with portions of the holder broken away to illustrate interior details.
Figure 4:
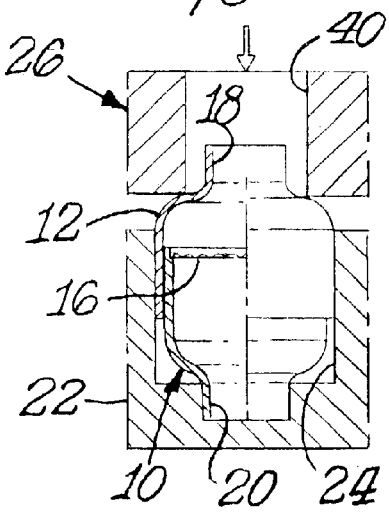
FIG. 4 is a fragmental sectional view of one filter holder in the press where the upper and lower portions thereof are pressed together with the press assembly of FIG. 3.

Referring in more particularity to the drawings, FIG. 1 is illustrious of a process for assembling a plurality of filter holders for use in a smoking machine. Such smoking machines and filter holders are old in the art, and FIG. 2 illustrates a filter holder 10 used for many years in smoking machines. Fundamentally, filter holder 10 comprises an upper portion 12 and a lower portion 14 constructed and arranged for fitting engagement with one another. A filter element 16 is placed between the upper and lower portions of the filter holder. Additionally, upper portion 12 includes a central opening 18 for receiving a cigarette while lower portion 14 includes a central opening 20 for releasable attachment to a smoking machine (not shown). As is well known, the smoking machine provides simulated puffs on lighted cigarettes attached to a plurality filter holders whereby tobacco smoke constituents are collected on the filter elements 16 for subsequent analysis.

As expressed in FIG. 1, filter holders 10 are loosely assembled with a filter element 16 between the upper and lower portions 12, 14 of each holder. The loosely assembled filter holders are then placed in a portable tray 22 having a plurality of individual compartments 24, one for each assembled filter holder. Tray 22 with the loosely assembled filter holders 10 is then positioned within a press 26 that functions to simultaneously press the filter holders to thereby seal the upper and lower portions 12, 14 of each filter holder 10 together with the filter element 16 therebetween. The sealed filter holders are then removed from the tray and loaded into the smoking machine.

Figure 3:
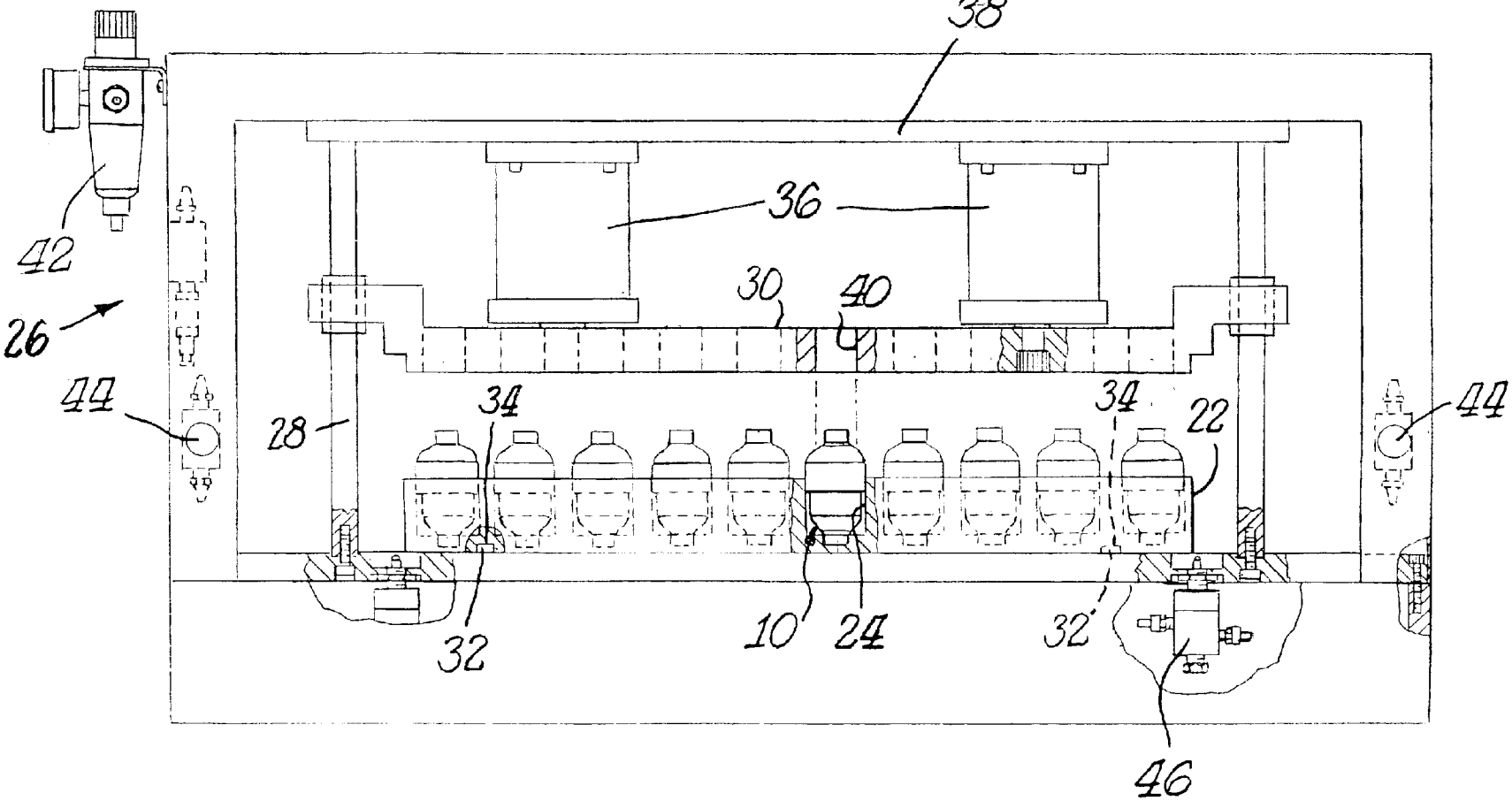
FIG. 3 is a front elevational view of a filter holder press assembly, according to the present invention, with portions thereof broken away to shown interior details.

FIG. 3 illustrates the portable tray 22 and press 26 in more detail. Basically, press 26 operates to simultaneously seal a plurality of filter holders 10 for subsequent use in a smoking machine. The press includes a framework 28 with a press platen 30 mounted to the framework for vertical movement. Framework 28 also supports the portable tray 22 directly below the press platen 30. Alignment structure on the framework in the form of projections 32 engage openings 34 in the bottom surface of the tray for positioning tray 22 at an exact predetermined location directly below the press platen 30. Hydraulic cylinders 36 are secured between an upper portion 38 of framework 28 and the press platen 30. Actuation of the hydraulic cylinders functions to move platen 30 in a vertical direction toward and away from tray 22.

Plural individual compartments 24 are provided in portable tray 22, one compartment for holding one of the plurality of loosely assembled filter holders 10. Press platen 30 also includes a plurality of individual compartments 40, one for engaging one of the plurality of the filter holders during pressing upon actuation of the hydraulic cylinders 36. Both the removable and portable tray 22 and the press platen 30 may include 20 compartments 24, 40 comprising two rows of 10 such compartments.

The overall press 26 includes an air gauge 42, actuator buttons 44 and a valving device 46, all used to properly activate movement of the press platen 30 toward and away from removable tray 22. After pressing of the filter holders to seal the upper and lower portions together, the holders are removed from the tray and releasably secured to the smoking machine.

What is claimed is:

1. A process for assembling a plurality of filter holders for use in a smoking machine comprising the steps of:

providing a plurality of filter holders, each holder having upper and lower portions constructed and arranged for fitting engagement with one another;

placing a filter element between the upper and lower portions of each filter holder;

loosely assembling each filter holder by fitting the upper and lower portions together with the filter element therebetween;

placing the loosely assembled filter holders on a portable tray having a plurality of individual compartments, one for each assembled filter holder;

positioning the tray with the loosely assembled filter holder thereon in a press; and simultaneously pressing the filter holders to thereby seal the upper and lower portions of each filter holder together with the filter element therebetween.

2. A process as in claim 1 wherein the tray with the loosely assembled filter holders thereon is positioned in the press at an exact predetermined location.

3. A process as in claim 2 including the step of providing the press with a press platen that engages the filter holders in the tray, and the press platen having a plurality compartments, one for each assembled filter holder for accommodating the filter holders during the pressing step.

4. A press for assembling a plurality of filter holders for use in a smoking machine comprising:

a framework;

a press platen mounted to the framework for vertical movement;

a portable and removable tray supported by the framework directly below the press platen;

alignment structure on the framework and the tray for positioning the tray at an exact predetermined location directly below the press platen;

at least one hydraulic cylinder connected between the framework and the press platen for moving the platen in a vertical direction toward and away from the tray;

a plurality of individual compartments in the tray, one compartment for holding one of a plurality of filter holders; and a plurality of individual compartments on the press platen, one for engaging one of a plurality of filter holders during pressing upon actuation of the at least one hydraulic cylinder.

5. A press as in claim 4 wherein the alignment structure includes at least one projection on the framework and at least one mating opening on the tray.

* * * * *